United States Patent [19]

Laconis

[11] Patent Number: 4,592,478

[45] Date of Patent: Jun. 3, 1986

[54] CONTAINER ASSEMBLY

[76] Inventor: Richard Laconis, 419 La Plaza Ct., Royal Oak, Mich. 48073

[21] Appl. No.: 656,978

[22] Filed: Oct. 2, 1984

[51] Int. Cl.[4] ..... B65D 21/02; B65D 1/04

[52] U.S. Cl. ..... 220/23.83; 206/77.1; 215/6; 215/10; 220/23.4; 220/23.86

[58] Field of Search ..... 220/23.83, 23.86, 23.4, 220/23.6, 20; 215/10, 6; 206/77.1

[56] References Cited

U.S. PATENT DOCUMENTS

| | | | |
|---|---|---|---|
| 180,132 | 7/1876 | Hoard | 215/6 |
| 529,762 | 11/1894 | VanWie | 215/6 |
| 776,140 | 11/1904 | Manahan | 215/6 |
| 3,658,204 | 4/1972 | Bottger | 215/6 |
| 3,688,895 | 9/1972 | Wilson | 206/77.1 |
| 3,732,999 | 5/1973 | Rounkles | 215/6 |
| 4,081,101 | 3/1978 | West | 220/23.83 |
| 4,125,207 | 11/1978 | Ernst | 215/6 |
| 4,235,343 | 11/1980 | Thompson | 215/10 |
| 4,280,643 | 7/1981 | Cordova | 206/77.1 |
| 4,435,030 | 3/1984 | Haven . | |

FOREIGN PATENT DOCUMENTS

| | | | |
|---|---|---|---|
| 546323 | 4/1956 | Belgium | 220/23.86 |

*Primary Examiner*—George E. Lowrance

*Attorney, Agent, or Firm*—Reising, Ethington, Barnard, Perry & Milton

[57] ABSTRACT

A container assembly (10) comprising a pair of liquid containers (12, 14) and a soap bar retention pocket (16). The retention pocket (16) is integral with the containers (12, 14) and forms an enclosure (18) for housing a bar of soap. A recess (20) in a wall (22) of one liquid container (14) receives a mating projection (36) from a wall (22) of the other container (12) to form the pocket (18). Alternatively, an independent soap bar container has mating halves (24, 26) received within respective recesses (20) in the liquid containers (12, 14).

9 Claims, 7 Drawing Figures

CONTAINER ASSEMBLY

TECHNICAL FIELD

The subject invention relates to shampoo dispensers used for bathing, specifically, portable dispensers of the type which may be easily transported to and from the bathing area.

BACKGROUND ART

Bathing is a function which may involve several different operations, each requiring separate accessories. In addition to a customary cleansing bar of soap or the like, one may also wish to shampoo and/or condition their hair while taking a bath or shower. For this purpose, it is necessary to carry separate shampoo and conditioner containers besides a bar of soap which may or may not be contained. In the home, this is often not a problem since all of the above accessories may be stored in the bathroom within arm's reach during use. However, when it is necessary to bathe or shower at a remote location, these accessories must all be carried along to where they will be used, for example, a hotel or gymnasium. Unlike a hotel bathroom, one cannot leave these accessories in the shower room while in the gymnasium. Instead, after exercising, the person must remove the accessories from a small locker and carry them to the shower. This is often an inconvenience since the person must manipulate two containers and a bar of soap, all of which may become slippery when wet. Further, the separate items may be forgotten.

The prior art contains numerous examples of dispensers for holding a plurality of collapsible tubes. U.S. Pat. No. 2,589,743 to Snaith discloses a combination duplex collapsible container and dispenser having a hanger for suspending the container in space. U.S. Pat. No. 2,166,307 discloses connected collapsible twin tubes which are joined by a dual collar bracket. Likewise, U.S. Pat. No. 2,819,723 to Meyer discloses a hair dyeing apparatus comprising a pair of containers each having a tube with the two tubes opening into a common applicator brush assembly.

The prior art set forth above does not provide a means for transporting or storing several bath accessories in a portable compact assembly.

STATEMENT OF INVENTION AND ADVANTAGES

According to the subject invention there is provided a container assembly comprising liquid container means and soap bar retainer means. The invention is characterized by the soap bar retention means being integral with the container means and forming a pocket for housing a bar of soap.

An advantage of the subject invention is that bathing accessories, such as a bar of soap and a shampoo bottle, may be connected together into a unitary assembly which may be easily transported and used in association with taking a shower or bath.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
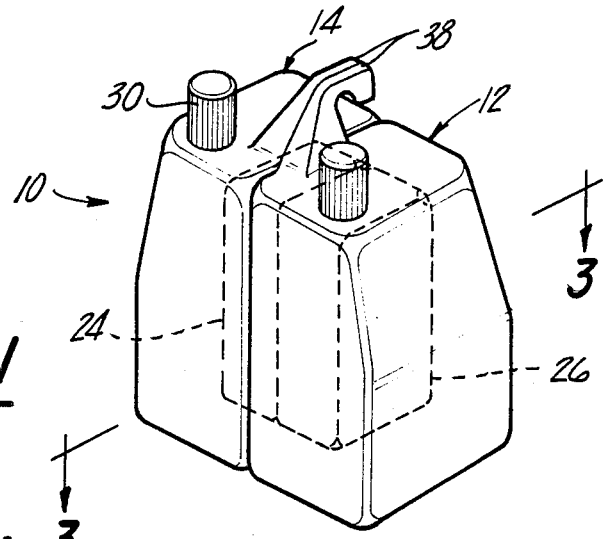
FIG. 1 is a perspective view of a preferred embodiment of the subject invention.

According to the subject invention there is provided a container assembly, generally shown at 10, comprising liquid container means in the form of a pair of liquid containers, generally indicated at 12 and 14, respectively, and soap bar retention means, generally indicated at 16. The invention is characterized by the retention means 16 being integral with the containers 12, 14 and forming a pocket 18 for housing a bar of soap 19. The liquid container means 12, 14 cooperate with the soap bar retention means 16 to form the pocket 18 therebetween.

Figure 2:
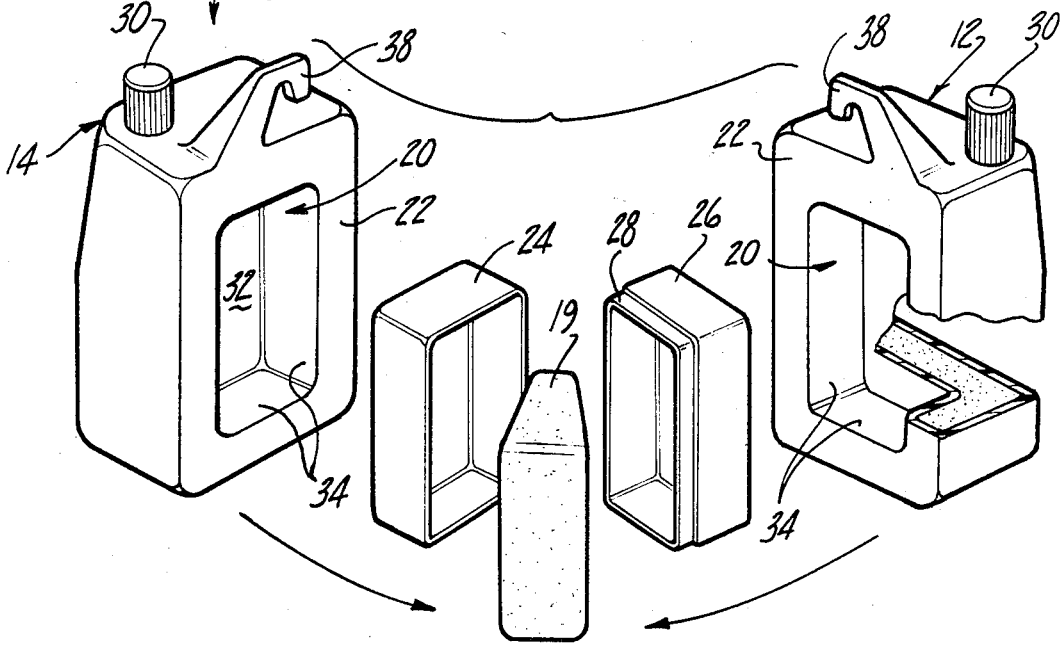
FIG. 2 is an exploded perspective view of the subject invention, including an independent soap bar container.
Figure 3:
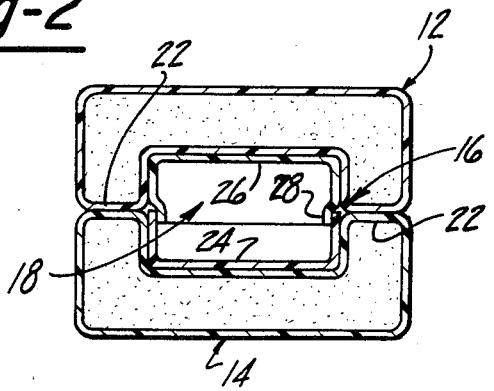
FIG. 3 is a cross section taken substantially along the lines 3—3 of FIG. 1.

With reference to the embodiment of FIGS. 1 through 3, the retention means 18 comprises a recess, generally indicated at 20, formed in a wall 22 of each of the liquid containers 12, 14, each recess 20 respectively receiving mating halves 24, 26 of an independent soap bar container. The halves 24, 26 are secured together by a flange 28.

Each of the liquid containers 12, 14 has a screw cap closure 30 which may optionally be provided with a flip-up type nozzle should squeeze-bottle type containers be desired. Preferably, the liquid containers 12, 14 are of unbreakable plastic having a series of ridges (not shown) formed in the halves 24, 26 (FIGS. 1–3) or also in the bottom 32 of the recesses 20, for facilitating removal of the soap bar 19 therefrom. The halves 24, 26 (FIGS. 1 through 3) are retained in the recesses 20 by frictional contact between the side walls thereof and the inner side walls 34 of each of the recesses 20. Other means may be employed for retaining and securing the halves 24, 26, e.g. clips, tabs, etc., within their respective recesses 20.

Figure 4:
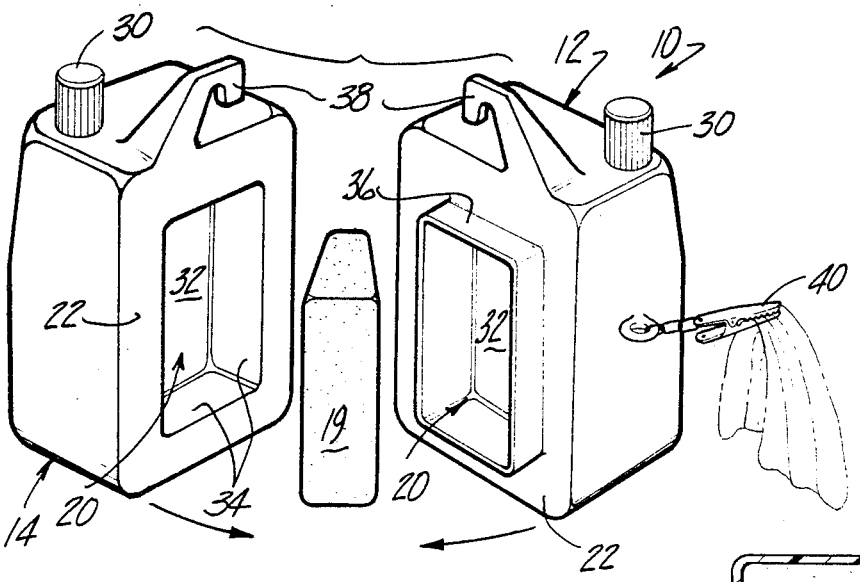
FIG. 4 is an exploded perspective view of an alternative embodiment of the subject invention, including an integral soap bar retention pocket.
Figure 5:
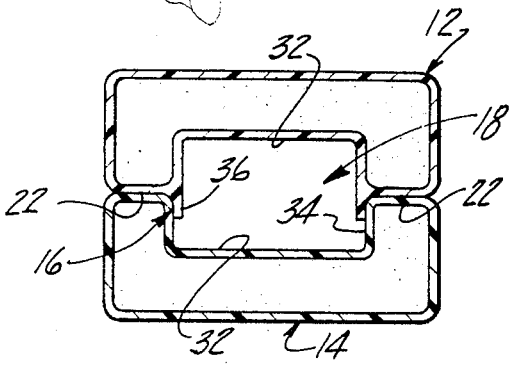
FIG. 5 is a cross-sectional view of the embodiment shown in FIG. 4.

With reference to FIGS. 4 and 5, there is provided a container assembly 10 wherein the pocket 18 is formed in a wall 22 of each of the liquid containers 12, 14. The soap bar retention means comprises a projection 36 extending outwardly from a wall 22 of one of the containers 12 and received within the recess 20 of the other container 14, defining the pocket 18 for housing the soap. The projection 36 has a size and configuration which is complementary to the recess 20 for frictional retention therein. The liquid container 12 having the projection 36 also has a recess 20 therein, the recess 20 having an outer periphery defined by the projection 36. By providing a recess 20 in both liquid containers 12, 14, each container 12, 14, though not identical, would have approximately the same volume.

In operation, the container 10 shown in FIG. 4 is assembled by moving each of the liquid containers 12, 14 in the direction of the arrows so that the projection 36 of the container 12 is inserted into frictional mating engagement with the side walls 34 of the recess 20 in the container 14, thus forming the pocket 18 enclosing the soap bar 19.

Figure 6:
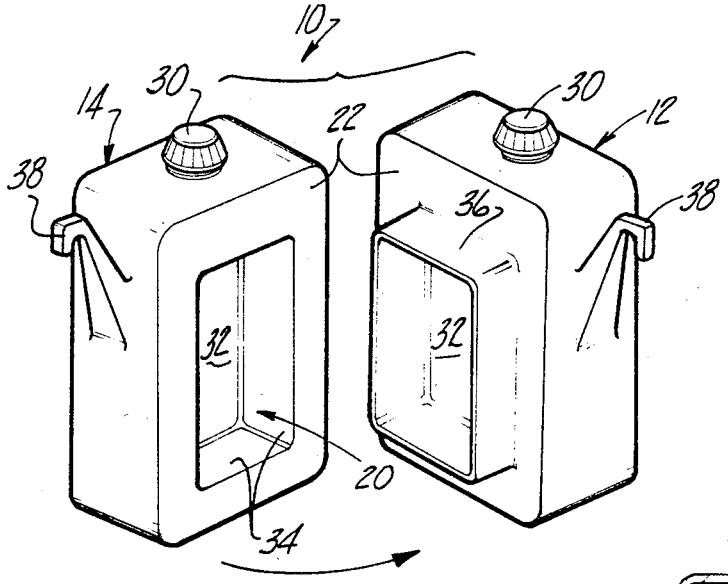
FIG. 6 is an exploded perspective view of another embodiment.
Figure 7:
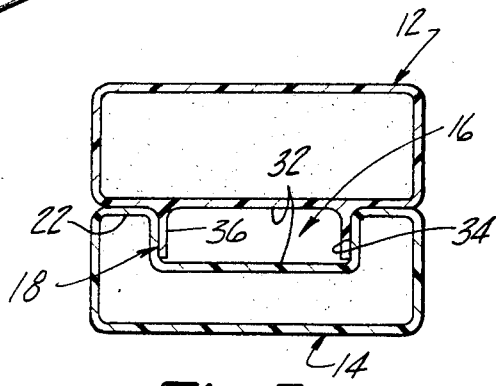
FIG. 7 is a cross-sectional view of the embodiment shown in FIG. 6.

The construction shown in FIGS. 6 and 7 differs in that a recess 20 is formed in only one of the containers 14 and receives a projection from the other container 12 for mating frictional engagement with the side walls 34 of the recess 20. When the pair of liquid containers 12, 14 are fully assembled together, the opposing walls 22 thereof will abut with the pocket 18 formed therebetween.

The liquid container 14 having the recess 20 therein may have the same relative configuration as the container 14 as shown in in FIGS. 4 through 7; in such a case, the pocket 18 formed when the assembly is closed in the direction of the arrow of FIG. 6 will only accommodate a smaller bar of soap. Of course, the recess in the container 14 can be deepened to accommodate a larger soap bar, resulting in a smaller volume of the container 14. This may be acceptable where the container 14 is to be used to hold hair conditioner of which a typically smaller quantity is used over time; moreover, the larger volume container 12 can accommodate shampoo of which a larger quantity is used during a bath or shower.

In all of the embodiments shown in FIGS. 1 through 7, handle means, such as a hook or hanger 38, is provided so that the container assembly 10 may be suspended from a shower nozzle or other suitable fixture while in storage or use. The hanger or hook 38 is provided on both of the containers 12, 14 to enable the selection of only one container 12, 14 and soap bar for use if desired; this versatility is particularly aided by the assembly shown in FIGS. 1 through 3 since the independent soap bar container halves 24, 26 are merely inserted into either of the recesses 20 in the respective containers 12, 14, allowing a person to take either soap and conditioner or soap and shampoo to the bath or shower location and suspend either container chosen by the hanger 38 provided. Thus, the containers 12, 14 may be used separately or together in any combination.

Alternatively, the embodiments shown in FIGS. 4 through 7 could be provided with a snap-on cover (not shown) fitting over the top of the projection 36, allowing the container 12 to be used singly with a bar of soap enclosed therein.

There is also included clamping means 40, such as an alligator-type clip or the like, for clamping a towel, washcloth or other object to one or both of the containers, 12, 14. For purposes of illustration, however, only one clip 40 is shown on one of the containers 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A container assembly (10) comprising a pair of liquid container means (12, 14) and soap bar retention means (16), characterized by said retention means (16) being integral with said container means (12, 14) and cooperating together therewith to define a pocket (18) for housing of a bar of soap (19) and frictionally securing said container assembly together.

2. An assembly as set forth in claim 1 further characterized by handle means (38) associated with at least one of said liquid containers (12, 14) for carrying and storing said container assembly.

3. An assembly as set forth in claim 1 further characterized by said pocket (18) being formed in at least one of said liquid containers (12, 14).

4. An assembly as set forth in claim 3 further characterized by said pocket being formed in one of said liquid containers (12, 14).

5. An assembly as set forth in claim 4 further characterized by said pocket (18) being formed in a wall (22) of each of said liquid containers.

6. An assembly as set forth in claim 3 further characterized by said soap bar retention means (16) comprising a projection (36) extending outwardly from a wall (22) of one of said liquid containers (12, 14) and received within a recess (20) formed in a wall of the other of said liquid containers (12, 14), defining said pocket (18) for housing a bar of soap (19).

7. An assembly as set forth in claim 5 further characterized by said soap bar retention means being defined by an independent closable soap bar container frictionally received within said pocket (18) to secure said containers together with said independent soap container sandwiched therebetween.

8. An assembly as set forth in claim 1 further characterized by clamping means (40) associated with the exterior of at least one of said liquid containers (12, 14) for clamping the object.

9. A container assembly (10) comprising: a pair of closable liquid containers (12, 14); a recess (20) formed in a wall (22) of at least one of said liquid containers (12, 14); a projection (36) extending outwardly from a wall (22) of one or the other of said liquid containers (12, 14) and frictionally received within said recess (20) to define a soap bar retention pocket (18) therebetween, frictionally securing said container assembly together.

* * * * *